US009752309B2

(12) United States Patent
Ayers

(10) Patent No.: US 9,752,309 B2
(45) Date of Patent: Sep. 5, 2017

(54) COMBINATION RINSING TUB FOR TOILET AND TRASH RECEPTACLE

(71) Applicant: Glenn Allen Ayers, Pompano Beach, FL (US)

(72) Inventor: Glenn Allen Ayers, Pompano Beach, FL (US)

( * ) Notice: Subject to any disclaimer, the term of this patent is extended or adjusted under 35 U.S.C. 154(b) by 0 days.

(21) Appl. No.: 14/823,280

(22) Filed: Aug. 11, 2015

(65) Prior Publication Data

US 2016/0040414 A1 Feb. 11, 2016

Related U.S. Application Data

(60) Provisional application No. 62/036,039, filed on Aug. 11, 2014.

(51) Int. Cl.

| | |
|---|---|
| ***E03C 1/33*** | (2006.01) |
| ***D06F 1/02*** | (2006.01) |
| ***E03D 11/02*** | (2006.01) |

(52) U.S. Cl.

CPC ..... *E03C 1/33* (2013.01); *D06F 1/02* (2013.01); *E03D 11/025* (2013.01)

(58) Field of Classification Search

CPC . D06F 7/00; D06F 51/00; D06F 41/00; B08B 11/02; B08B 11/00

USPC .... 4/661, 666; 68/235 D, 223, 225, 226, 14, 68/232, 233, 237, 13 R, 205 D, 208

See application file for complete search history.

(56) References Cited

U.S. PATENT DOCUMENTS

| | | | | |
|---|---|---|---|---|
| 1,239,176 A | | 9/1917 | Gilbert | |
| 1,557,983 A | * | 10/1925 | Coker | D06F 41/00 68/205 D |
| 1,783,147 A | | 11/1930 | Barnard | |
| 1,795,376 A | * | 3/1931 | Edwin | D06F 41/00 68/205 D |
| 2,329,623 A | * | 9/1943 | Judy | D06F 1/00 239/562 |
| 2,348,102 A | * | 5/1944 | Baker | D06F 41/00 68/205 D |
| 2,473,852 A | | 6/1949 | Berry | |
| 2,882,708 A | | 4/1959 | Hancock et al. | |

(Continued)

OTHER PUBLICATIONS

Cloth Diaper Rinsing System. [online] [retrieved on Jun. 24, 2016]. Retrieved from the Internet at <<http://www.pottypail.com/the-potty-pail-complete.

*Primary Examiner* — Erin Deery

(74) *Attorney, Agent, or Firm* — Kintner IP, LLC; Mary Frances Ludwig

(57) ABSTRACT

A rinsing apparatus that is a combination toilet rinsing tub and trash receptacle is provided for rinsing soiled items into a toilet while avoiding splashing or otherwise contaminating the apparatus's user and surrounding areas. The rinsing apparatus includes a rinsing tub having an opening that accesses an interior rinsing space, which are defined by a wall or walls of the rinsing tub. The rinsing tub also includes a drain port located at or near a bottom portion of the rinsing tub, which permits contaminants to drain out of the rinsing tub and into a bowl of a toilet. The rinsing apparatus further includes at least two legs that are useful both for allowing the apparatus to stand in a stable vertical position on a floor and also to sit securely on a rim of a toilet bowl while the apparatus is being used to rinse a soiled item.

15 Claims, 6 Drawing Sheets

(56) References Cited

U.S. PATENT DOCUMENTS

| | | | | | |
|---|---|---|---|---|---|
| 2,909,053 | A | | 10/1959 | Coatsworth | |
| 2,928,270 | A | | 3/1960 | Olson | |
| 3,018,488 | A | | 1/1962 | Snead | |
| 3,122,011 | A | | 2/1964 | Martin | |
| 3,253,435 | A | * | 5/1966 | Berk | D06F 41/00 134/155 |
| 3,277,675 | A | * | 10/1966 | Scott | D06F 39/088 215/228 |
| 3,308,640 | A | | 3/1967 | Russey | |
| 3,318,119 | A | * | 5/1967 | Barks | D06F 41/00 4/239 |
| 3,611,758 | A | | 10/1971 | Miller et al. | |
| 3,860,971 | A | | 1/1975 | Dirks | |
| 3,914,988 | A | | 10/1975 | Avoy | |
| 4,807,308 | A | | 2/1989 | Person et al. | |
| 5,050,408 | A | | 9/1991 | Toupin et al. | |
| 5,375,270 | A | | 12/1994 | Demers, Jr. et al. | |
| 6,463,601 | B1 | | 10/2002 | Fetty | |
| 7,913,871 | B2 | * | 3/2011 | Fisher | B65F 1/06 220/495.06 |
| 8,434,173 | B1 | | 5/2013 | Drew | |
| 9,322,122 | B2 | | 4/2016 | Aprea et al. | |

* cited by examiner

COMBINATION RINSING TUB FOR TOILET AND TRASH RECEPTACLE

CROSS-REFERENCE TO RELATED APPLICATIONS

This application is a nonprovisional application of and claims priority from U.S. provisional patent application Ser. No. 62/036,039 filed on Aug. 11, 2014. The foregoing application is incorporated in their entirety herein by reference.

FIELD OF THE INVENTION

The present invention relates to a rinsing and cleaning apparatus. More particularly, the present invention relates to a combination toilet rinsing tub and trash receptacle for rinsing soiled items into a toilet without splashing, splattering or contaminating a user of the apparatus and surrounding areas.

BACKGROUND OF THE INVENTION

In conventional methods for removing contaminants from soiled items (such as, for example, cloth diapers, undergarment, baby and adult clothing, bedpans, a bowl of a potty chair or potty toilet, and more), the methods involved rinsing the soiled items directly into or over a toilet with a handheld sprayer attached to a potable water supply. Soiled items were also rinsed in a flat bottom bucket or pail, with a hole cut in the bottom and placed on the rim of a toilet bowel. Soiled items were also rinsed with a handheld spray shield. In other conventional rinsing methods, soiled items were rinsed of large contaminants (such as, for example, fecal matter or vomit) either by depositing the soiled item directly into water inside the toilet in a swishing motion or by pouring of water from a bucket or other receptacle directly onto the soiled item as the soiled item was held over or just inside of the bowl of the toilet.

Such conventional methods for rinsing soiled items are often undesirable because they do not help to reduce splattering, and in the case of methods using a flat bottomed bucket or other flat bottomed receptacle, cannot prevent contaminated water from splattering off the bottom of the bucket or other receptacle. Flat bottomed buckets and receptacles cannot quickly drain and require additional rinsing until contaminates are rinsed down the hole causing more splashing off the flat bottom thereby further creating contaminated water mist. Flat bottomed buckets and receptacles sitting on a rim of the toilet also cause splashing in the toilet water as the water drains from the drain hole located through the bottom of the bucket, which bottom and drain hole are positioned above the rim of the toilet bowl when sitting on the rim. Spray shields are difficult to use because the user must hold the shield out of the water or place it in the contaminated water while rinsing. Flat bottomed buckets, pails, other receptacles, and shields placed in a drip pan on the floor sit directly in the drain water, which contaminates the bottom of the bucket, pail, other receptacle, or shield.

A need exists for an apparatus and methods that permit soiled items to be rinsed to remove contaminants, and particularly larger contaminants such as fecal matter, into a toilet while avoiding splashing and contamination of surrounding surfaces, outside surfaces of the apparatus, surfaces of the toilet outside of the toilet bowl, and the user's skin, hair, and clothing. A need also exists for a rinsing tub that can be used as a trash receptacle when it is not in use for rinsing soiled items over a toilet.

SUMMARY OF THE INVENTION

The present invention relates to a duel use rinsing tub and trash receptacle apparatus designed to sit on a rim of a toilet's bowl during use for rinsing or on the floor when not in use. The apparatus includes a rinsing tub with at least two legs attached thereto. The legs prevent the tub from sliding or falling off of the toilet rim when the apparatus is being used to rinse soiled items over the toilet. The legs also elevate the drain port above the floor allowing a drip pan to be placed under a drain port of the rinsing tub when placed on the floor after use. The rinsing tub allows the user to place or hang soiled items, like cloth diapers, undergarments, bedpans, a bowl of a potty chair or potty toilet, and more inside the rinsing tub and rinse with water, e.g., water from a handheld pressurized sprayer draining into the toilet or water poured from a bucket or other receptacle onto the soiled item. The rinsing tub makes the very unpleasant task of removing contaminants (e.g., feces, urine, vomit, blood, dirt, debris, etc.) from any soiled item much easier while avoiding contamination of the user or of surrounding surfaces since the contaminants on the soiled item are carried by water flow downward into the rinsing tub and through the rinsing tub's drain port to exit into the toilet bowl where such contaminants may be disposed of by flushing the toilet. The apparatus also can be placed upright on a floor standing on its legs and used as a trash receptacle by placing a trash bag inside.

The rinsing tub can include side walls that angle downward at a lower portion proximal to the drain port. The downward angle of the rinsing tub's lower portion allows water and contaminants to be rinsed and drain out of the rinsing tub while eliminating any back splash or contaminated water mist splattering onto the user and surrounding surfaces as well as avoiding excessive odor and sight of the contaminants. When the apparatus is set onto the toilet rim, the drain port is located just above the toilet water allowing for minimum splashing as the dirty water and contaminants drains into the water inside the toilet bowl.

The apparatus's legs allow the drip pan to be placed under the drain port of the rinsing tub when the apparatus is placed on the floor so that the apparatus can be quickly removed from the toilet without the necessity to dry the interior walls of the rinsing tub. The apparatus's legs also hold the rinsing tub's drain port above the drip pan so that lowermost portion of the rinsing tub at the drain port is not sitting in the water that drains into the drip pan from the rinsing tub or from soiled items hanging inside the rinsing tub for drying after rinsing. The drain port is designed so that the bottom edge of the rinsing tub that forms the drain port inserts into the top opening of the drip pan and extends downward into the drip pan just below a rim of the drip pan located at the drip pan's top opening. This configuration allows for water dripping out of the rinsing tub's drain port to be captured in the drip pan and then disposed of, for example, by emptying the drip pan into the toilet after the rinsing tub (or the soiled items placed into it or hung on its rim) has drained and dried.

The apparatus and its related methods are advantageous for allowing soiled items to be rinsed to remove contaminants, and particularly larger contaminants such as fecal matter, into a toilet while avoiding splashing and contamination of surrounding surfaces, outside surfaces of the apparatus, surfaces of the toilet outside of the toilet bowl, and the user's skin, hair, and clothing.

The apparatus and its related methods are also advantageous because they provide a rinsing tub that can be used as a trash receptacle when it is not in use for rinsing soiled items over a toilet.

The apparatus and its related methods provide yet another advantage in that the apparatus can be quickly removed from the rim of the toilet bowl and placed over a drip pan to collect additional water and residual contaminants that may drip out of the rinsing tub through the drain port when the apparatus is stood upright on its legs on the floor while not in use for rinsing.

Accordingly, the invention features a combination rinsing tub and trash receptacle apparatus that includes a rinsing tub and at least two legs. The rinsing tub can include an upper opening that opens into an interior space that is defined by at least one receptacle wall. The interior space can be sufficiently sized to receive a soiled item for rinsing contaminants from the soiled item. The rinsing tub further includes a drain port located generally at a bottom portion of the rinsing tub. The at least two legs are attached to the rinsing tub and allow removable installation of the apparatus onto a rim of a toilet bowl when the apparatus is being used to rinse the soiled item.

In another aspect, the invention can feature the at least two legs extending downward so that when the apparatus is removably installed on the rim of the toilet bowl, the at least two legs contact and extend downward from the rim in the direction of a base of the toilet so as to hold the apparatus in position on the rim of the toilet bowl when the apparatus is in use for rinsing the soiled item.

In another aspect, the invention can feature the at least two legs being attached opposite one another on opposing left and right side walls of the rinsing tub.

In another aspect, the invention can feature the at least two legs including four legs, wherein the four legs are installed in pairs on opposing left and right side walls of the rinsing tub.

In another aspect, the invention can feature each of the at least two legs having an outer side that is oriented away from the rinsing tub and an inner side that is oriented toward the rinsing tub.

In another aspect, the invention can feature the inner side of each leg including a horizontal leg member comprising a generally flat bottom surface that is oriented downward and that is connected at a generally right angle to a vertical leg member. The vertical leg member can include a generally flat inner surface that is oriented inward facing in the direction of the drain port of the rinsing tub.

In another aspect, the invention can feature one of the horizontal leg members and one of the vertical leg members of each leg forming a single unitary piece.

In another aspect, the invention can feature the generally perpendicular attachment of the horizontal leg member and the vertical leg member stabilizing the apparatus for removably installing the apparatus on the rim of the toilet bowl when the apparatus is being used to rinse the soiled item, wherein the bottom surface of the horizontal leg member rests upon an upper surface of the rim and the inner surface of the vertical leg member contacts a side surface of the rim thereby holding the apparatus in position over the toilet bowl during use.

In another aspect, the invention can feature a bottom portion of the rinsing tub extending downward a sufficient distance with respect to each bottom surface of each horizontal leg member so that when the bottom surface of each horizontal leg member is resting upon the upper surface of the rim of the toilet bowl, the drain port of the rinsing tub is located at a position that is inside the toilet bowl and lower than the upper surface of the rim.

In another aspect, the invention can feature the rinsing tub being wider at the upper opening and converging toward the drain port.

In another aspect, the invention can feature the at least one receptacle wall including four walls permanently connected so as to form a generally rectangular shape at the upper opening of the rinsing tub, wherein the four walls include a front wall, a rear wall, a left side wall, and a right side wall.

In another aspect, the invention can feature at least one of the left side wall and the right side wall angling downward gradually to converge at the drain port.

In another aspect, the invention can feature at least one of the left side wall and the right side wall including a generally vertical upper portion and a lower portion having a sloped curvature that terminates at the drain port.

In another aspect, the invention can feature at least one of the left side wall and the right side wall including a plurality of corrugations against which the soiled item may be scrubbed to dislodge contaminants as water is poured or sprayed into the rinsing tub and onto the soiled item.

In another aspect, the invention can feature an upper portion of the at least one receptacle wall including a lip that curves outward to permit a trash bag to be securely installed inside the interior space and over the upper portion of the at least one receptacle wall of the rinsing tub so that the apparatus is usable as a trash receptacle when it is not in use for rinsing soiled items.

In another aspect, the invention can feature the soiled item being a cloth diaper, an undergarment, an article of baby clothing, an article of adult clothing, a bedpan, a toilet seat bowl, a bowl of a potty chair or potty toilet, a bib, or any other soiled item capable of fitting within the interior space of the rinsing tub.

The invention also features a combination rinsing tub and trash receptacle apparatus that includes a rinsing tub and at least two legs. The rinsing tub can include an upper opening that opens into an interior space that is defined by at least one receptacle wall. The interior space can be sufficiently sized to receive a soiled item for rinsing contaminants from the soiled item. The rinsing tub further includes a drain port located generally at a bottom portion of the rinsing tub. The at least two legs are attached to the rinsing tub and allow removable installation of the apparatus onto a rim of a toilet bowl when the apparatus is being used to rinse the soiled item. Each of the at least two legs includes an outer side that is oriented away from the rinsing tub and an inner side that is oriented toward the rinsing tub. The inner side of each leg includes a horizontal leg member comprising a generally flat bottom surface that is oriented downward and that is connected at a generally right angle to a vertical leg member. The vertical leg member includes a generally flat inner surface that is oriented inward facing in the direction of the drain port of the rinsing tub. The generally perpendicular attachment of the horizontal leg member and the vertical leg member stabilize the apparatus for removably installing the combination rinsing tub and trash receptacle apparatus on the rim of the toilet bowl when the apparatus is being used to rinse the soiled item, wherein the bottom surface of the horizontal leg member rests upon an upper surface of the rim and the inner surface of the vertical leg member contacts a side surface of the rim thereby holding the apparatus in position over the toilet bowl during use.

A method of the invention can be used to rinse contaminants from a soiled item into a toilet bowl while avoiding contamination of a user and surrounding surfaces by splashing, dripping, or leaking. The method includes the step of: (a) removably installing a combination rinsing tub and trash receptacle apparatus onto a rim of a toilet bowl, wherein the apparatus includes a rinsing tub and at least two legs. The rinsing tub can include an upper opening that opens into an interior space that is defined by at least one receptacle wall. The interior space can be sufficiently sized to receive a soiled item for rinsing contaminants from the soiled item. The rinsing tub further includes a drain port located generally at a bottom portion of the rinsing tub. The at least two legs are attached to the rinsing tub and allow removable installation of the apparatus onto a rim of a toilet bowl when the apparatus is being used to rinse the soiled item. The method further includes the steps of: (b) placing a soiled item into the interior space of the rinsing tub through the upper opening; and (c) introducing water via pouring or spraying onto the soiled item to remove contaminants, wherein the contaminants are carried by water to the drain port where the contaminants pass out of the rinsing tub and into the toilet bowl.

Another method of the invention can include the step of: (d) removing the apparatus from the rim of the toilet bowl and placing it on a floor standing upright on its at least two legs over a drip pan placed on the floor so that the drain port is aligned above the drip pan to permit water on an interior surface of the rinsing tub's at least one receptacle wall to drain by dripping out of the drain port into the drip pan until the interior surface has dried.

Another method of the invention can include the step of: (e) installing a trash bag inside the interior space of the rinsing tub so that the apparatus is usable as a trash receptacle when it is not being used to rinse soiled items.

Unless otherwise defined, all technical terms used herein have the same meaning as commonly understood by one of ordinary skill in the art to which this invention belongs. Although methods and materials similar or equivalent to those described herein can be used in the practice or testing of the present invention, suitable methods and materials are described below. All publications, patent applications, patents and other references mentioned herein are incorporated by reference in their entirety. In the case of conflict, the present specification, including definitions will control.

DETAILED DESCRIPTION

Figure 1:
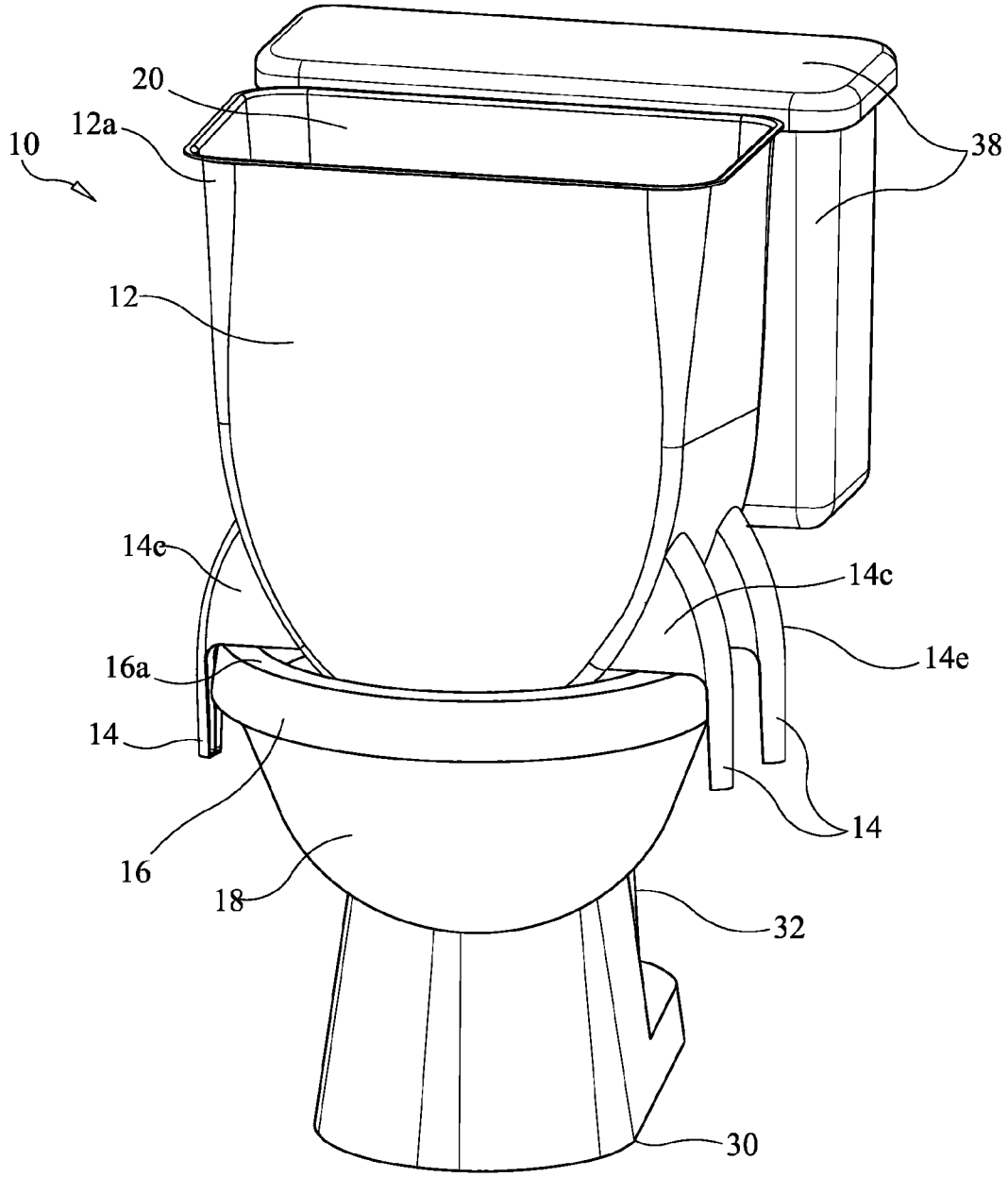
FIG. 1 is a perspective front view of a combination toilet rinsing tub and trash receptacle positioned on a rim of a toilet bowl rim ready for use.

The present invention is best understood by reference to the detailed drawings and description set forth herein. Embodiments of the invention are discussed below with reference to the drawings; however, those skilled in the art will readily appreciate that the detailed description given herein with respect to these figures is for explanatory purposes as the invention extends beyond these limited embodiments. For example, in light of the teachings of the present invention, those skilled in the art will recognize a multiplicity of alternate and suitable approaches, depending upon the needs of the particular application, to implement the functionality of any given detail described herein beyond the particular implementation choices in the following embodiments described and shown. That is, numerous modifications and variations of the invention may exist that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention should not be limited to the particular methodology, compounds, materials, manufacturing techniques, uses, and applications, described herein, as these may vary. The terminology used herein is used for the purpose of describing particular embodiments only, and is not intended to limit the scope of the present invention. As used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" may be a reference to one or more steps or means and may include sub-steps and subservient means.

All conjunctions used herein are to be understood in the most inclusive sense possible. Thus, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should be read as "and/or" unless expressly stated otherwise. Structures described herein are to be understood also to refer to functional equivalents of such structures. Language that may be construed to express approximation should be so understood unless the context clearly dictates otherwise.

Unless otherwise defined, all terms (including technical and scientific terms) are to be given their ordinary and customary meaning to a person of ordinary skill in the art, and are not to be limited to a special or customized meaning unless expressly so defined herein.

Terms and phrases used in this application, and variations thereof, especially in the appended claims, unless otherwise expressly stated, should be construed as open ended as opposed to limiting. As examples of the foregoing, the term "including" should be read to mean "including, without limitation," "including but not limited to," or the like; the term "having" should be interpreted as "having at least"; the term "includes" should be interpreted as "includes but is not limited to"; the term "example" is used to provide exemplary instances of the item in discussion, not an exhaustive or limiting list thereof; and use of terms like "preferably," "preferred," "desired," "desirable," or "exemplary" and words of similar meaning should not be understood as implying that certain features are critical, essential, or even important to the structure or function of the invention, but instead as merely intended to highlight alternative or additional features that may or may not be utilized in a particular embodiment of the invention.

Those skilled in the art will also understand that if a specific number of an introduced claim recitation is intended, such an intent will be explicitly recited in the claim, and in the absence of such recitation no such intent is present. For example, as an aid to understanding, the appended claims may contain usage of the introductory phrases "at least one" and "one or more" to introduce claim recitations; however, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C" is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.).

All numbers expressing dimensions, quantities of ingredients, reaction conditions, and so forth used in the specification are to be understood as being modified in all instances by the term "about" unless expressly stated otherwise. Accordingly, unless indicated to the contrary, the numerical parameters set forth herein are approximations that may vary depending upon the desired properties sought to be obtained.

Figure 2:
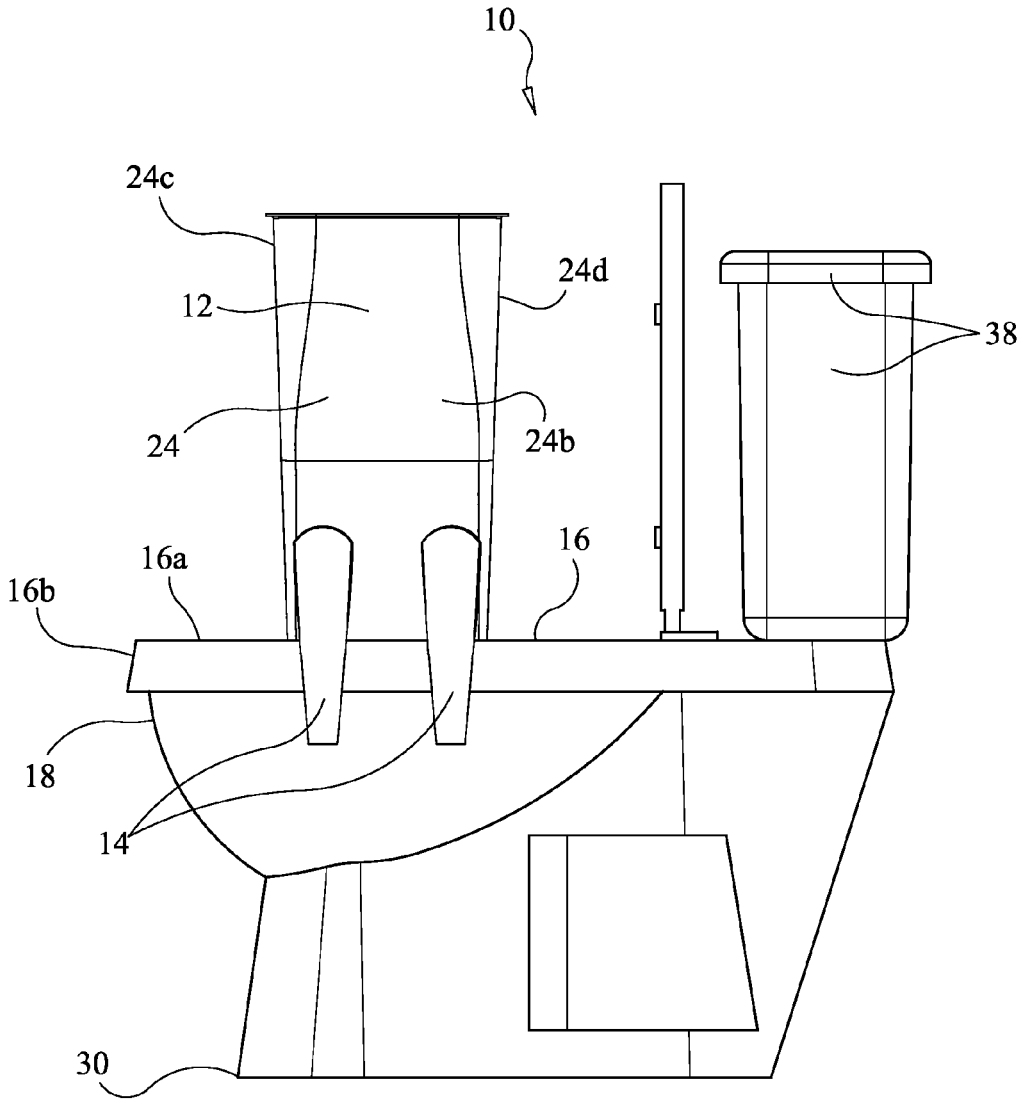
FIG. 2 is a side view of the combination toilet rinsing tub and trash receptacle positioned on the rim of the toilet bowl ready for use.

The invention provides a combination rinsing tub and trash receptacle apparatus 10 that includes a rinsing tub 12 and at least two legs 14. FIGS. 1 and 2 show one exemplary embodiment of the apparatus removably installed on a rim 16 of a toilet bowl 18 of a toilet 32. The rinsing tub 12 can include an upper opening 20 at its top portion 12*a* that opens into an interior space 22 that is defined by at least one receptacle wall 24. In some embodiments, the at least one receptacle wall 24 can be a single continuous generally cylindrical wall. In other embodiments, the at least one receptacle wall 24 can be rectangular in cross-section with either rounded or angular corners. In the exemplary embodiment shown in the FIGS. 1, 4, and 5, the at least one receptacle wall 24 can include four walls permanently connected so as to form a generally rectangular shape at the upper opening (i.e., in horizontal cross-section) of the rinsing tub 12. In the exemplary embodiment shown in the drawings, the four walls can include a left side wall 24*a*, a right side wall 24*b*, a front wall 24*c*, and a rear wall 24*d*. The interior space 22 of the rinsing tub 12 can be sufficiently sized to receive a soiled item for rinsing contaminants from the soiled item. The rinsing tub 12 further includes a drain port 26 located generally at a bottom portion 12*b* of the rinsing tub. The at least two legs 14 are attached to the rinsing tub 12 and allow removable installation of the apparatus 10 onto the rim 16 of the toilet bowl 18 when the apparatus is being used to rinse the soiled item.

The at least one receptacle wall 24 of the rinsing tub 12 can be constructed of a sufficient height that the user is not required to bend or lean over or stoop much or at all in order to rinse the soiled item that is placed into the interior space 22 of the rinsing tub 12. The height of the at least one receptacle wall also reduces or eliminates splashing and water mist that might otherwise exit the upper opening and contaminate the user and surrounding surfaces if the at least one receptacle wall were shorter in height. In exemplary embodiments, the height of the at least one receptacle wall 24 can be the same as or higher than the height of a flush tank 38 of the toilet 32 when the apparatus is installed on the rim 16 of the toilet bowl 18. The upper opening is sized so as to be large enough to permit the placement of one or more soiled items within the interior space 22 of the rinsing tub 12. The drain port 26 may be sized so as to be large enough to permit water and contaminants to pass through and into the toilet bowl but small enough that soiled items may not fall through the drain port and into the toilet bowl.

Figure 3:
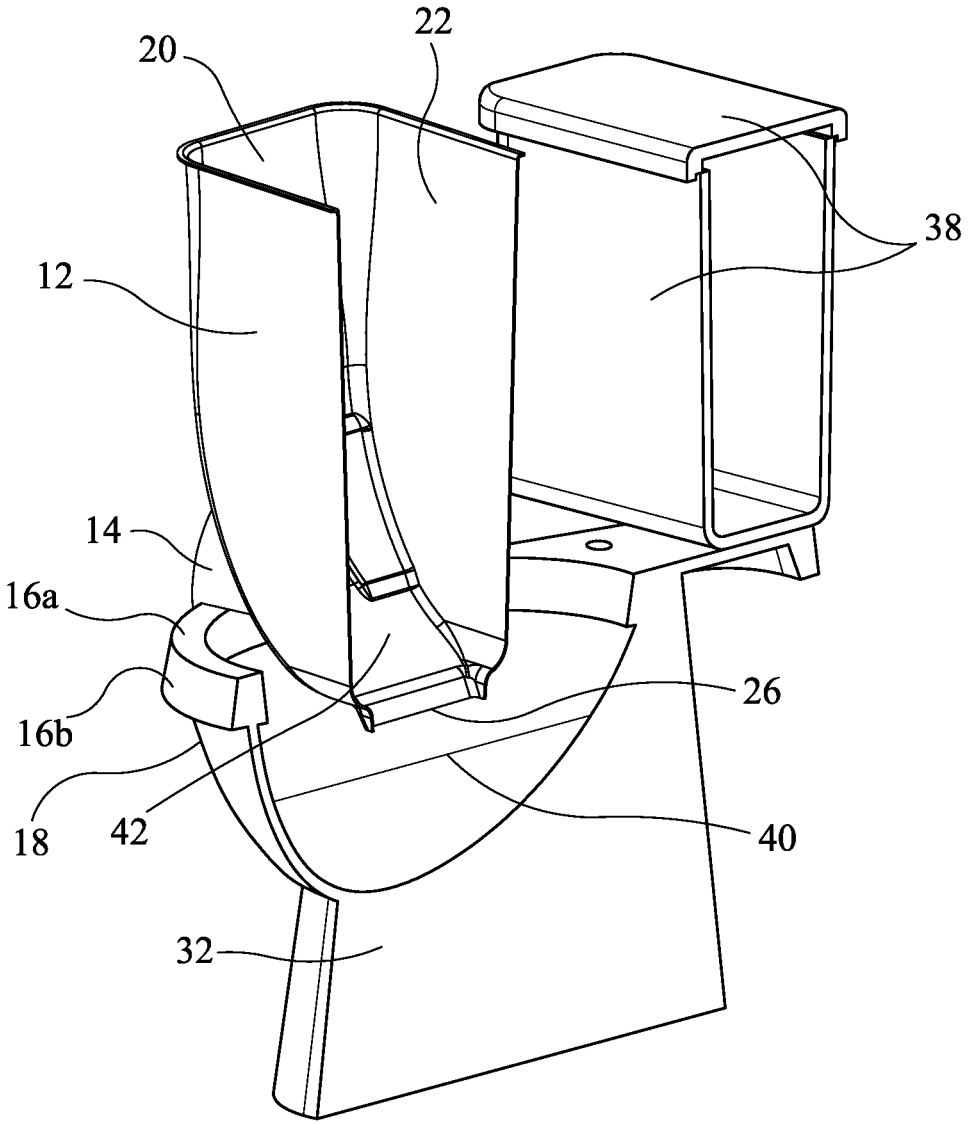
FIG. 3 is a cut-away perspective view of the combination toilet rinsing tub and trash receptacle positioned on the toilet bowl rim ready for use and showing an interior surface of walls of a rinsing tub's downward angled fast-draining splash-preventing drain port.
Figure 4:
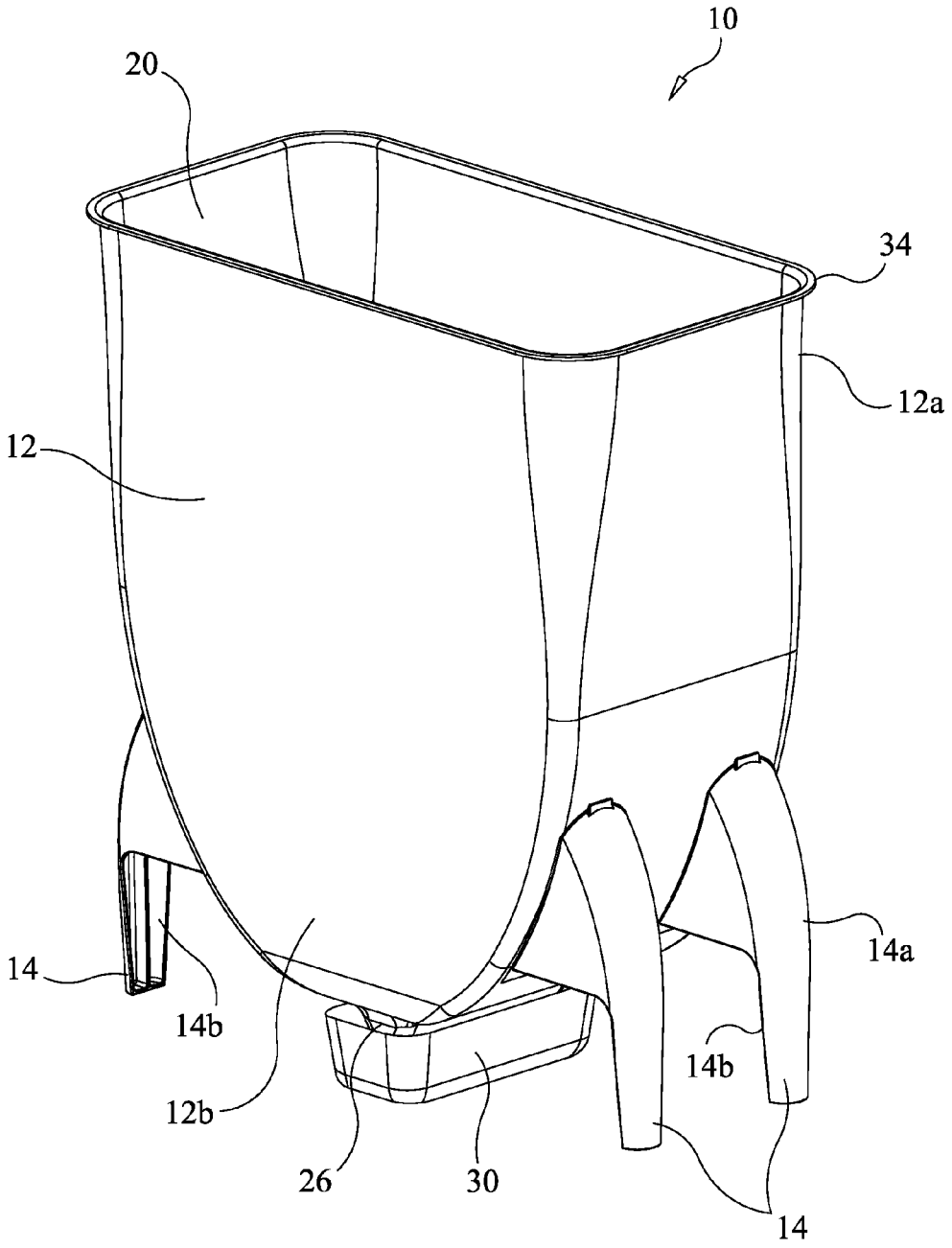
FIG. 4 is a perspective view of the combination toilet rinsing tub and trash receptacle sitting on the floor (e.g., after rinsing of a soiled item over a toilet bowl has been completed) with a drip pan positioned beneath the drain port.
Figure 5:
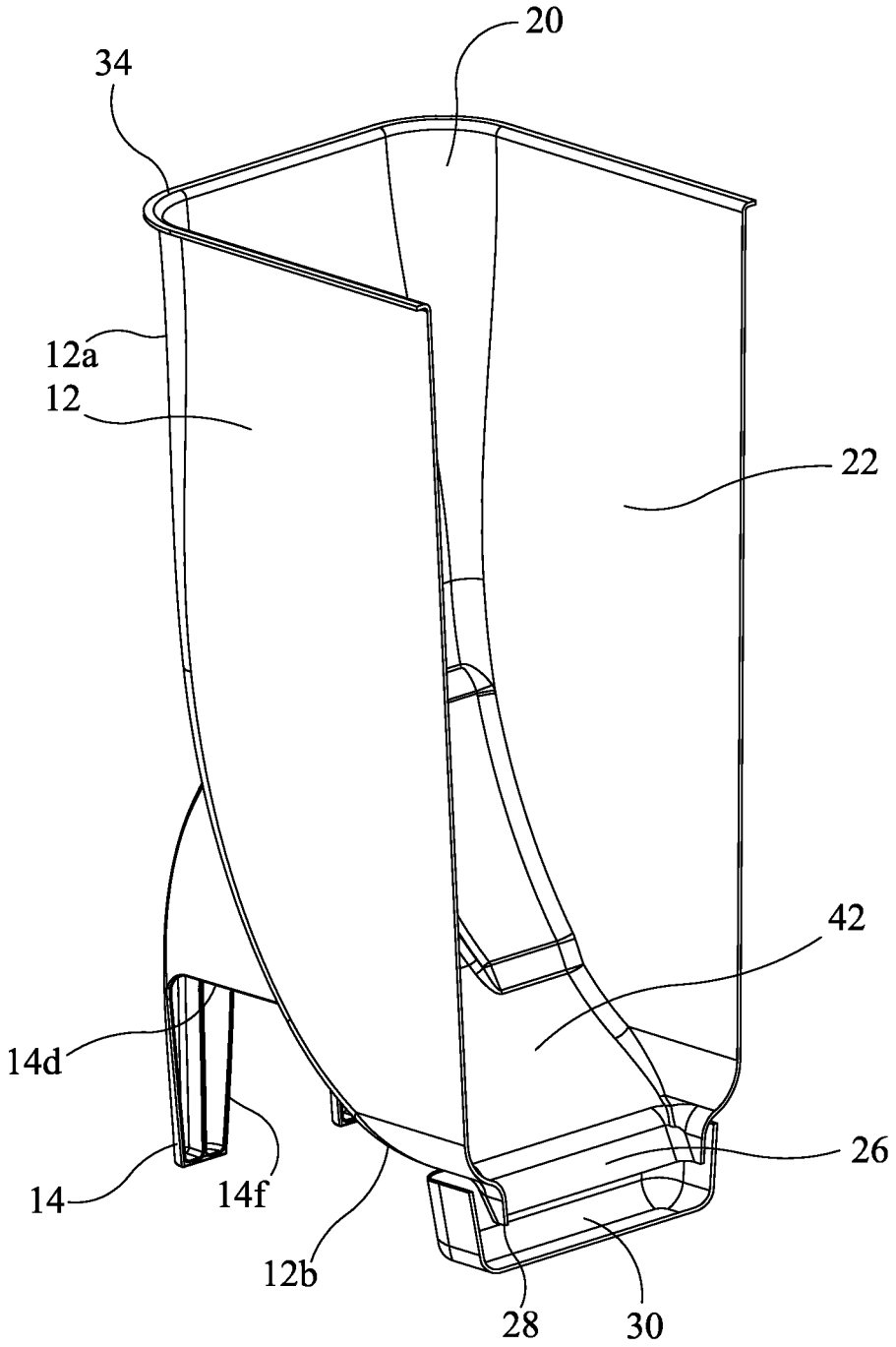
FIG. 5 is a cut-away perspective view of the combination toilet rinsing tub and trash receptacle showing the drip pan positioned beneath the drain port of the rinsing tub.

In exemplary embodiments of the apparatus, the rinsing tub 12 can be wider at the upper opening 20 and converging toward the drain port 26. At least one of the left side wall 24*a* and the right side wall 24*b* (or both) can be constructed so that it or they angle or slope downward gradually to converge at the drain port. In exemplary embodiments as shown in FIGS. 3, 4, and 5, at least one of the left side wall 24*a* and the right side wall 24*b* (or both) can include a generally vertical upper portion and a lower portion having a sloped curvature that terminates at the drain port. In other embodiments, the left side wall 24*a*, the right side wall 24*b*, the front wall 24*c*, and the rear wall 24*d* may also slope downward to converge at or near the drain port.

The drain port 26 can include an aperture that is formed in and generally flush with the bottom portion 12*b* of the rinsing tub 12. In exemplary embodiments, however, the drain port 26 may include a lip 28 that extends downward and surrounds an aperture through which water and contaminants may pass out of the rinsing tub.

The at least two legs 14 can extend downward so that when the apparatus 10 is removably installed on the rim 16 of the toilet bowl 18, the at least two legs contact and extend downward from the rim 16 in the direction of a base 30 of the toilet 32 so as to hold the apparatus 10 in position on the rim of the toilet bowl 18 when the apparatus is in use for rinsing the soiled item. To provide maximum stability when the apparatus is placed onto the toilet bowl's rim, the at least two legs can be attached opposite one another on opposing left and right side walls 24*a* and 24*b* of the rinsing tub 12.

In an exemplary embodiment, the apparatus can include four legs, wherein the four legs are installed in pairs on opposing left and right side walls of the rinsing tub. In another embodiment, the apparatus can include an additional leg that is attached to the front wall of the rinsing tub in addition to the at least two legs that are attached to the left and right side walls. The additional leg can provide additional securing of the apparatus to the rim of the toilet bowl when the apparatus is installed thereon for rinsing soiled items.

Each of the at least two legs 14 has an outer side 14*a* that is oriented away from the rinsing tub 12 and an inner side 14*b* that is oriented toward the rinsing tub. In the exemplary embodiment shown in FIGS. 1 and 4, the inner side 14*b* of each leg 14 can include a horizontal leg member 14*c* comprising a generally flat bottom surface 14*d* that is oriented downward and that is connected at a generally right angle to a vertical leg member 14*e*. The vertical leg member 14*e* can include a generally flat inner surface 14*f* that is oriented inward facing in the direction of the drain port 26 of the rinsing tub 12. In exemplary embodiments such as those shown in the drawings, each leg 14 can be a single unitary piece. In other embodiments, each leg can be constructed from a separate and discrete horizontal leg member 14*c* that is attached, either permanently or removably, to a separate and discrete vertical leg member 14*e*.

The generally perpendicular attachment of the horizontal leg member 14*c* and the vertical leg member 14*e* stabilize the apparatus 10 for removably installing the apparatus on the rim of the toilet bowl when the apparatus is being used to rinse the soiled item. The bottom surface 14*d* of the horizontal leg member 14*c* rests upon an upper surface 16*a* of the rim 16 and the inner surface 14*f* of the vertical leg member 14*e* contacts a side surface 16*b* of the rim 16 thereby holding the apparatus 10 in position over the toilet bowl 18 during use for rinsing soiled items.

The bottom portion 12*b* of the rinsing tub 12 can extend downward a sufficient distance with respect to each bottom surface 14*d* of each horizontal leg member 14*c* so that when the bottom surface 14*d* of each horizontal leg member 14*c* is resting upon the upper surface 16*a* of the rim 16 of the toilet bowl 18, the drain port of the rinsing tub is located at a position that is inside the toilet bowl and lower than the upper surface 16*a* of the rim. The downward angle or curvature of the lower portion of the rinsing tub's left, right, or both side walls allows water and contaminants to be rinsed and drain out of the rinsing tub while eliminating any back splash or contaminated water mist splattering onto the user and surrounding surfaces as well as avoiding excessive odor and sight of the contaminants. As shown in FIG. 3, when the apparatus 10 is set onto the toilet rim 16, the drain port 26 is located just above the toilet water 40 allowing for minimum splashing as the dirty water and contaminants drain into the water inside the toilet bowl 18.

In addition to securing the apparatus to the rim of the toilet bowl during use of the apparatus for rinsing soiled items, the legs also serve to support the rinsing tub above the a drip pan 30 when the apparatus is stood upright on the floor. After use of the apparatus for rinsing a soiled item, the drip pan 30 may be aligned beneath the drain port of the rinsing tub to collect any water or residual contaminants that drip out of the rinsing tub until it is dry. The drip pan can be a pan or other receptacle shaped and sized to receive the drain port of the rinsing tub. As shown in FIGS. 4 and 5, when placed on a floor or other ground surface beneath the drain port, walls of the drip pan 30 can be tall enough to terminate at their highest point at a height that is higher than the lowest point of the drain port thereby reducing splashing of water and contaminants out of the drip pan and onto surrounding surfaces.

In one embodiment of the apparatus, at least one of the left side wall 24*a* and the right side wall 24*b* can include a plurality of corrugations (not shown in the drawings) against which the soiled item may be scrubbed to dislodge contaminants as water is poured or sprayed into the rinsing tub and onto the soiled item. In other embodiments, both the left and right side walls or all of the rinsing tub's walls may include corrugations on their interior surfaces.

Figure 6:
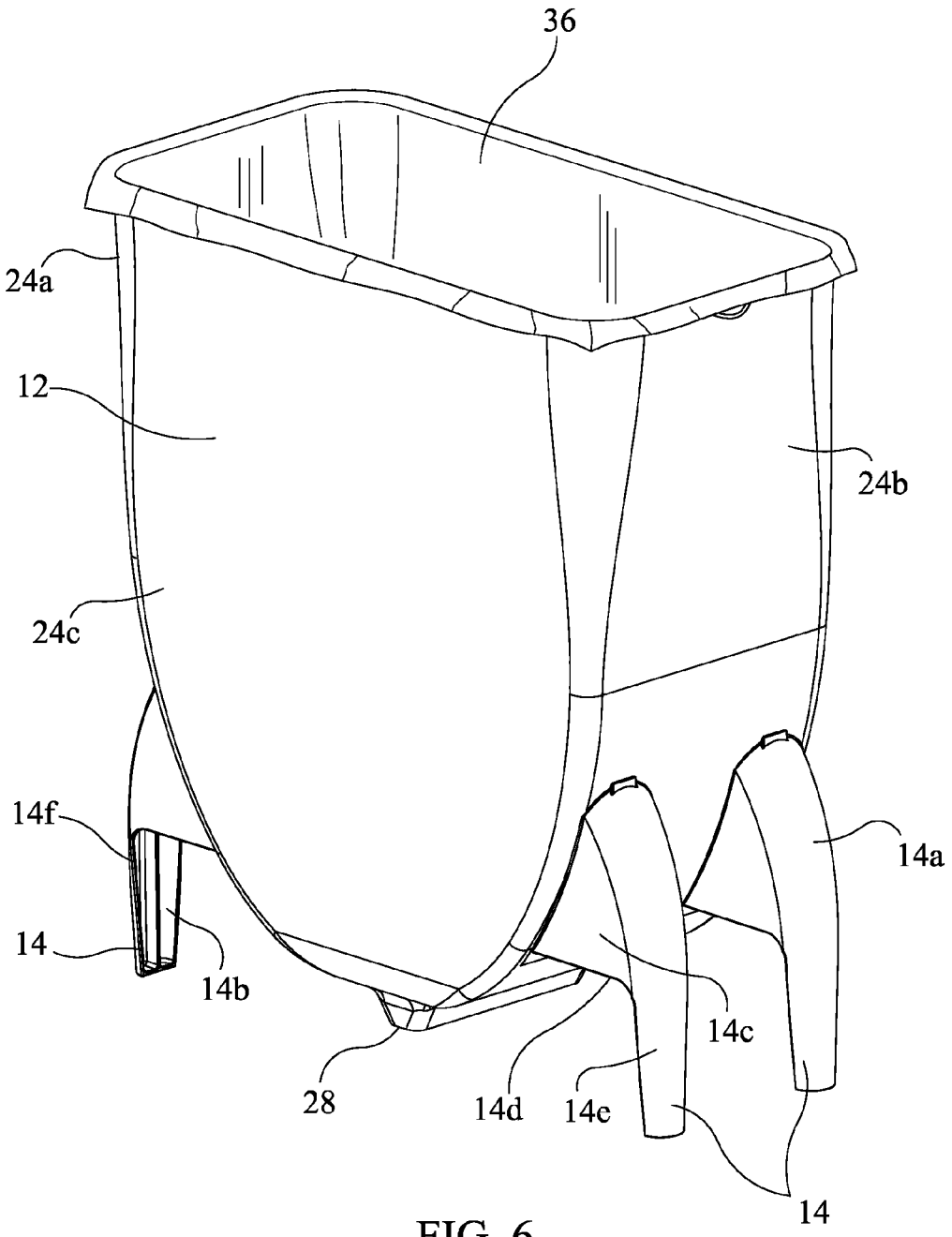
FIG. 6 is a perspective view of the combination toilet rinsing tub and trash receptacle sitting on the floor after use without the drip pan positioned beneath the drain port and with a trash bag installed inside an interior space of the rinsing tub so that the apparatus is ready for use as a trash receptacle.

The upper portion 12*a* of the rinsing tub 12 can include a lip 34 attached to a top of the at least one receptacle wall 24. The lip can curve outward to permit a trash bag 36 to be securely installed inside the interior space 22 and over the upper portion 12*a* of the at least one receptacle wall 24 of the rinsing tub 12, as shown in FIG. 6, so that the apparatus 10 is usable as a trash receptacle when it is not in use for rinsing soiled items. The smooth curve of the lip 34 also permits article of clothing and other soiled items made from fabric to be hung on or draped over the upper portion 12*a* of the at least one receptacle wall 24 of the rinsing tub 12 after the soiled item has been rinsed but while it is still dripping water while avoiding picking and snagging of the fabric of the soiled item that might result if the upper portion 12*a* forming the upper opening 20 were more angular or rough in texture.

The apparatus may be constructed from plastic, metal (for example, aluminum or stainless steel), or any other suitable material that is resistant to corrosion. In some embodiments, the interior surfaces 42 of the at least one receptacle wall may be coated with an anti-corrosion coating, an anti-microbial coating, or both. In other embodiments, exterior surfaces of the apparatus may also be coated with an anti-corrosion coating, an anti-microbial coating, or both. In some embodiments, interior surfaces of the drip pan may be coated with an anti-corrosion coating, an anti-microbial coating, or both. In other embodiments, exterior surfaces of the drip man may also be coated with an anti-corrosion coating, an anti-microbial coating, or both. The aforementioned anti-microbial coatings may also feature properties that reduce odors that might otherwise emanate from the apparatus and its drip pan. One or more of the aforementioned surfaces may also include non-stick coatings that inhibit the ability of contaminants to cling or otherwise become attached to the interior surfaces of the rinsing tub and drip pan for easy flushing of such contaminants out of the rinsing tub and drip pan using water that is sprayed or poured.

Examples of soiled items that may be rinsed using the apparatus include a cloth diaper, an undergarment, an article of baby clothing, an article of adult clothing, a bedpan, a toilet seat bowl, a bowl of a potty chair or potty toilet, a bib, or any other soiled item capable of fitting within the interior space of the rinsing tub. Contaminants of the soiled item can include, for example, feces, urine, vomit, blood, dirt, debris, etc.

The invention also relates to a method that can be used to rinse contaminants from a soiled item into a toilet bowl while avoiding contamination of a user and surrounding surfaces by splashing, dripping, or leaking during the rinsing of the soiled item. The method includes the step of removably installing a combination rinsing tub and trash receptacle apparatus, such as the one described elsewhere herein, onto a rim of a toilet bowl. The apparatus is installed on the rim of the toilet bowl by lifting a lid of the toilet and then resting the legs of the apparatus on the rim of the toilet bowl (as described in more detail elsewhere herein) so that the bottom portion of the rinsing tub and its drain port are positioned inside the toilet bowl just above, but not in contact with, the water inside the toilet bowl and at a position that is lower than the rim of the toilet bowl. Next, a soiled item can be placed into the interior space of the rinsing tub through the upper opening. Water can then be introduced into the interior space and onto the soiled item via pouring or spraying onto the soiled item to remove contaminants. The contaminants are carried by the flow of water to the drain port where the contaminants pass out of the rinsing tub and into the toilet bowl where they may be disposed of sanitarily by flushing the toilet.

Once the user is satisfied with the degree of contaminant removal from the soiled item, the method can include the steps of removing the soiled item from the rinsing tub and spraying or pouring water onto the interior surfaces of the at least one receptacle wall to flush all or most contaminants off of the rinsing tub, through the drain port, and into the toilet bowl for disposal by flushing.

The method can include the step of removing the apparatus from the rim of the toilet bowl and placing it on a floor standing upright on its at least two legs over a drip pan placed on the floor so that the drain port is aligned above the drip pan to permit water on the interior surface of the rinsing tub's at least one receptacle wall to drain by dripping out of the drain port into the drip pan until the interior surface has dried. Water and any residual contaminants that are collected in the drip pan by draining from the rinsing tub through the drain port can be disposed of in similar manner, for example, by emptying into the toilet bowl and flushing the toilet.

Soiled items that have been rinsed of most or all contaminants using the apparatus and method can be hung on or draped over the lip of the of rinsing tub surrounding the upper opening. By doing so, soiled items can be permitted to drip until fully or partially dry so that water dripping from the soiled item passes into the interior space of the rinsing tub and out of the drain port into the drip pan. When the soiled item has dried sufficiently for removal from the rinsing tub, the rinsing tub may be rinsed over the toilet one or more additional times to flush away any residual contaminants that may be present on the interior surface of the apparatus's at least one receptacle wall.

When the method is used with embodiments of the apparatus that include corrugations (or ridges) on the interior surface of the at least one receptacle wall, soiled items made from cloth or other fabric (e.g., cloth diapers, undergarments, other articles of clothing, and bibs) may be scrubbed against the corrugations to dislodge contaminants, particularly contaminants of larger sizes as well as those that are clinging to or embedded in the fabric, for rinsing into the toilet bowl through the drain port. This step of the method can be performed when water is being poured or sprayed into the interior space of the rinsing tub and onto the soiled item.

When the apparatus is not installed on a toilet bowl and is sitting on a floor or other ground surface, a trash bag may be placed or installed inside the interior space of the rinsing tub so that the apparatus is usable as a trash receptacle when it is not being used to rinse soiled items. In this embodiment of the method, the apparatus can serve as a bathroom or restroom trash receptacle when it is not installed on the toilet and being used for rinsing soiled items.

Other Embodiments

It is to be understood that while the invention has been described in conjunction with the detailed description thereof, the foregoing description is intended to illustrate and not limit the scope of the invention, which is defined by the scope of the appended claims. Other aspects, advantages, and modifications are within the scope of the following claims.

What is claimed is:

1. A combination rinsing tub and trash receptacle apparatus comprising:

a rinsing tub comprising an upper opening that opens into an interior space, wherein the interior space is sized to receive a soiled item for rinsing contaminants from the soiled item, and wherein the rinsing tub further comprises:

a drain port located generally at a lower portion of the rinsing tub; and at least two side walls that define the interior space of the rinsing tub, each of the at least two side walls having a generally vertical upper side wall portion and a downwardly sloped lower side wall portion, the lower side wall portions converging toward and terminating at the drain port;

at least two legs each projecting outwardly from one of the downwardly sloped lower side wall portions, each of the at least two legs located between the vertical upper side wall portions and the drain port, each of the at least two legs comprising an outer side that is oriented away from the rinsing tub and an inner side that is oriented toward the rinsing tub, wherein the at least two legs allow removable installation of the apparatus onto a rim of a toilet bowl when the apparatus is being used to rinse the soiled item; and, the inner side of each leg comprising a horizontal leg member comprising a generally flat bottom surface that is oriented downward and that is connected at a generally perpendicular orientation to a vertical leg member comprising a generally flat inner surface that is oriented inward facing in the direction of the drain port of the rinsing tub;

wherein, the lower side wall portions extend downward a distance below each bottom surface of each horizontal leg member so that when the bottom surface of each horizontal leg member is resting upon the upper surface of the rim of the toilet bowl, (i) the lower side wall portions are positioned at least partially inside the toilet bowl; and (ii) the drain port is located at a position that is inside the toilet bowl and below the rim of the toilet bowl to minimize splashing as contaminants are rinsed from the soiled item and out of the drain port of the rinsing tub.

2. The apparatus of claim 1, wherein the at least two legs extend downward so that when the apparatus is removably installed on the rim of the toilet bowl, the at least two legs contact and extend downwardly from the rim in the direction of a base of the toilet so as to hold the apparatus in position on the rim of the toilet bowl when the apparatus is in use for rinsing the soiled item.

3. The apparatus of claim 1, wherein the at least two side walls comprise opposing left and right side walls, and wherein the at least two legs are attached opposite one another on the opposing left and right side walls of the rinsing tub.

4. The apparatus of claim 1, wherein the at least two side walls comprise opposing left and right side walls, wherein the at least two legs comprise four legs, and wherein the four legs are installed in pairs on the opposing left and right side walls of the rinsing tub.

5. The apparatus of claim 1, wherein each leg comprised of one of the horizontal leg members and one of the vertical leg members comprises a single unitary piece.

6. The apparatus of claim 1, wherein the generally perpendicular orientation of the horizontal leg member and the vertical leg member stabilizes the apparatus for removably installing the apparatus on the rim of the toilet bowl when the apparatus is being used to rinse the soiled item, wherein the bottom surface of the horizontal leg member rests upon an upper surface of the rim and the inner surface of the vertical leg member contacts a side surface of the rim thereby holding the apparatus in position over the toilet bowl during use.

7. The apparatus of claim 1, wherein the rinsing tub is wider at the upper opening and converges toward the drain port.

8. The apparatus of claim 1, wherein the at least two side walls comprise four walls permanently connected so as to form a generally rectangular shape at the upper opening of the rinsing tub, wherein the four walls comprise a front wall, a rear wall, a left side wall, and a right side wall.

9. The apparatus of claim 8, wherein at least one of the left side wall and the right side wall angles downward to converge at the drain port.

10. The apparatus of claim 1, wherein an upper portion of the rinsing tub comprises a lip that curves outward to permit a trash bag to be securely installed inside the interior space and over the upper portion of the rinsing tub so that the apparatus is usable as a trash receptacle when it is not in use for rinsing soiled items.

11. The apparatus of claim 1, wherein the interior space of the rinsing tub is sized to receive a cloth diaper, an undergarment, an article of baby clothing, an article of adult clothing, a bedpan, a toilet seat bowl, a bowl of a potty chair or potty toilet, or a bib.

12. A combination rinsing tub and trash receptacle apparatus comprising:

a rinsing tub comprising an upper opening that opens into an interior space that is defined by at least two side walls, each of the at least two side walls having a generally vertical upper side wall portion and a downwardly sloped lower side wall portion, the lower side wall portions converging toward and terminating at a drain port, wherein the interior space is sized to receive a soiled item for rinsing contaminants from the soiled item, wherein the drain port is located generally at a lower portion of the rinsing tub;

at least two legs each projecting outwardly from one of the downwardly sloped lower side wall portions, each of the at least two legs located between the vertical upper side wall portions and the drain port, wherein the at least two legs allow removable installation of the apparatus onto a rim of a toilet bowl when the apparatus is being used to rinse the soiled item, wherein each of the at least two legs comprises an outer side that is oriented away from the rinsing tub and an inner side that is oriented toward the rinsing tub;

wherein the inner side of each leg comprises a horizontal leg member comprising a generally flat bottom surface that is oriented downward and that is connected at a generally perpendicular orientation to a vertical leg member comprising a generally flat inner surface that is oriented inward facing in the direction of the drain port of the rinsing tub;

wherein the generally perpendicular connection of the horizontal leg member and the vertical leg member stabilizes the apparatus for removably installing the combination rinsing tub and trash receptacle apparatus on the rim of the toilet bowl when the apparatus is being used to rinse the soiled item, wherein the bottom surface of the horizontal leg member rests upon an upper surface of the rim and the inner surface of the vertical leg member contacts a side surface of the rim thereby holding the apparatus in position over the toilet bowl during use; and wherein, the lower side wall portions extend downward a distance below each bottom surface of each horizontal leg member so that when the bottom surface of each horizontal leg member is resting upon the upper surface of the rim of the toilet bowl, (i) the lower side wall portions are positioned at least partially inside the toilet bowl; and (ii) the drain port is located at a position that is inside the toilet bowl and below the rim of the toilet bowl to minimize splashing as contaminants are rinsed from the soiled item and out of the drain port of the rinsing tub.

13. A method for rinsing contaminants from a soiled item into a toilet bowl while avoiding contamination of a user and surrounding surfaces by splashing, dripping, or leaking, the method comprising the steps of:

(a) removably installing a combination rinsing tub and trash receptacle apparatus onto a rim of a toilet bowl, wherein the apparatus comprises:

a rinsing tub comprising an upper opening that opens into an interior space that is defined by at least two side walls, wherein the interior space is sized to receive a soiled item for rinsing contaminants from the soiled item, wherein the rinsing tub further comprises a drain port located generally at a lower portion of the rinsing tub;

at least two side walls that define the interior space of the rinsing tub, each of the at least two side walls having a generally vertical upper side wall portion and a downwardly sloped lower side wall portion, the lower side wall portions converging toward and terminating at the drain port;

at least two legs each projecting outwardly from one of the downwardly sloped lower side wall portions, each of the at least two legs located between the vertical upper side wall portions and the drain port, attached to the rinsing tub, each of the at least two legs comprising an outer side that is oriented away from the rinsing tub and an inner side that is oriented toward the rinsing tub, wherein the at least two legs allow removable installation of the apparatus onto the rim of the toilet bowl when the apparatus is being used to rinse the soiled item; and the inner side of each leg comprising a horizontal leg member comprising a generally flat bottom surface that is oriented downward and that is connected at a generally perpendicular orientation to a vertical leg member comprising a generally flat inner surface that is oriented inward facing in the direction of the drain port of the rinsing tub;

wherein, when the apparatus is installed onto the rim of the toilet bowl, (i) the lower side wall portions are positioned at least partially inside the toilet bowl; and (ii) the drain port is located below the rim of the toilet bowl to minimize splashing as contaminants are rinsed from the soiled item and out of the drain port of the rinsing tub;

(b) placing the soiled item into the interior space of the rinsing tub through the upper opening; and (c) introducing water via pouring or spraying onto the soiled item to remove contaminants, wherein the contaminants are carried by water to the drain port where the contaminants pass out of the rinsing tub and into the toilet bowl.

14. The method of claim 13, further comprising the step of:

(d) removing the apparatus from the rim of the toilet bowl and placing it on a floor standing upright on its at least two legs over a drip pan placed on the floor so that the drain port is aligned above the drip pan to permit water on an interior surface of the rinsing tub's at least two side walls to drain by dripping out of the drain port into the drip pan until the interior surface has dried.

15. The method of claim 13, further comprising the step of:

(e) installing a trash bag inside the interior space of the rinsing tub so that the apparatus is usable as a trash receptacle when it is not being used to rinse soiled items.

* * * * *